US010512969B2

(12) United States Patent
Ikuta et al.

(10) Patent No.: US 10,512,969 B2
(45) Date of Patent: Dec. 24, 2019

(54) UP-DRAWING CONTINUOUS CASTING METHOD AND UP-DRAWING CONTINUOUS CASTING APPARATUS

(71) Applicant: TOYOTA JIDOSHA KABUSHiKi KAISHA, Toyota-shi (JP)

(72) Inventors: Hiroyuki Ikuta, Nisshin (JP); Yuto Tanaka, Toyota (JP); Naoaki Sugiura, Takahama (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 710 days.

(21) Appl. No.: 15/128,805

(22) PCT Filed: Mar. 17, 2015

(86) PCT No.: PCT/IB2015/000460
§ 371 (c)(1),
(2) Date: Sep. 23, 2016

(87) PCT Pub. No.: WO2015/145252
PCT Pub. Date: Oct. 1, 2015

(65) Prior Publication Data

US 2018/0221940 A1 Aug. 9, 2018

(30) Foreign Application Priority Data

Mar. 28, 2014 (JP) ..... 2014-067987

(51) Int. Cl.
*B22D 11/05* (2006.01)
*B22D 11/14* (2006.01)
(Continued)

(52) U.S. Cl.
CPC ..... *B22D 11/05* (2013.01); *B22D 11/145* (2013.01); *B22D 11/168* (2013.01); *B22D 11/124* (2013.01)

(58) Field of Classification Search
CPC ..... B22D 11/05; B22D 11/145; B22D 11/168; B22D 11/124; B22D 11/041; B22D 11/01; B22D 11/14; B22D 11/141
See application file for complete search history.

(56) References Cited

U.S. PATENT DOCUMENTS

| | | | |
|---|---|---|---|
| 6,217,803 | B1 | 4/2001 | Uozumi |
| 2013/0171021 | A1 | 7/2013 | Yaokawa et al. |
| 2015/0071817 | A1 | 3/2015 | Sasaki et al. |

FOREIGN PATENT DOCUMENTS

| | | | |
|---|---|---|---|
| JP | 63-199050 | A | 8/1988 |
| JP | 9-248657 | A | 9/1997 |

(Continued)

OTHER PUBLICATIONS

International Search Report dated Jul. 17, 2015 in PCT/IB2015/000460, filed Mar. 17, 2015.

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

An up-thawing continuous casting method includes drawing up molten metal (M1) held in a holding furnace (101), through a shape determining member (102) that determines a sectional shape of a cast casting (M3). The sectional shape determined by the shape determining member (102) includes a round-cornered portion, and a value (Rf) of a curvature radius of the round-cornered portion that is determined by the shape determining member (102) is smaller than a design value (Rt) of a curvature radius of a round-cornered portion of the casting (M3).

6 Claims, 7 Drawing Sheets

(51) Int. Cl.
*B22D 11/16* (2006.01)
*B22D 11/124* (2006.01)

(56) References Cited

FOREIGN PATENT DOCUMENTS

| | | | |
|---|---|---|---|
| JP | 2012-61518 | A | 3/2012 |
| WO | WO 2012/035752 | A1 | 3/2012 |
| WO | WO 2013/136785 | A1 | 9/2013 |

UP-DRAWING CONTINUOUS CASTING METHOD AND UP-DRAWING CONTINUOUS CASTING APPARATUS

BACKGROUND OF THE INVENTION

1. Field of the Invention

The invention relates to an up-drawing continuous casting method and an up-drawing continuous casting apparatus.

2. Description of Related Art

Japanese Patent Application Publication No. 2012-61518 (JP 2012-61518 A) proposes a free casting method as a groundbreaking up-drawing continuous casting method that does not require a mold. As described in JP 2012-61518 A, a starter is first dipped into the surface of molten metal (i.e., a molten metal surface), and then when the starter is drawn up, molten metal is also drawn up following the starter by surface tension and the surface film of the molten metal. Here, a casting that has a desired sectional shape is able to be continuously cast by drawing up the molten metal through a shape determining member arranged near the molten metal surface, and cooling the drawn up molten metal.

With a normal continuous casting method, the sectional shape and the shape in the longitudinal direction are both determined by a mold. In particular, with a continuous casting method, the solidified metal (i.e., the casting) must pass through the mold, so the cast casting takes on a shape that extends linearly in the longitudinal direction. In contrast, the shape determining member in the free casting method determines only the sectional shape of the casting. The shape in the longitudinal direction is not determined. Therefore, castings of various shapes in the longitudinal direction are able to be obtained by drawing the starter up while moving the starter (or the shape determining member) in a horizontal direction. For example, JP 2012-61518 A describes a hollow casting (i.e., a pipe) formed in a zigzag shape or a helical shape, not a linear shape in the longitudinal direction.

The inventors discovered the problem described below. With the free casting method described in JP 2012-61518 A, molten metal is drawn up through the shape determining member, so a solidification interface is positioned higher than the shape determining member, just as described above. Here, from the viewpoint of productivity, it is preferable to increase the casting speed (i.e., the up-drawing speed), but when the casting speed is increased, the solidification interface rises. When the solidification interface rises, the surface area of the molten metal that has been drawn up through the shape determining member increases, and as a result, the surface tension increases. Therefore, if the casting speed is increased when casting a casting having a round-cornered portion in the sectional shape that is determined by the shape determining member, the curvature radius of the round-cornered portion of the cast casting will end up being larger than the desired curvature radius originally determined by the shape determining member.

That is, with the up-drawing continuous casting method according to the related art, when casting a casting having a round-cornered portion in the sectional shape that is determined by the shape determining member, the casting speed is unable to be increased, which impedes productivity and is therefore problematic.

SUMMARY OF THE INVENTION

The invention provides an up-drawing continuous casting method and an up-drawing continuous casting apparatus that offer excellent productivity of a casting having a round-cornered portion in a sectional shape that is determined by a shape determining member.

A first aspect of the invention relates to an up-drawing continuous casting method that includes drawing up molten metal held in a holding furnace, through a shape determining member that determines a sectional shape of a cast casting. The sectional shape determined by the shape determining member includes a round-cornered portion, and a value of a curvature radius of the round-cornered portion that is determined by the shape determining member is smaller than a design value of a curvature radius of a round-cornered portion of the casting. According to this kind of structure, in addition to increasing the casting speed, the curvature radius of the round-cornered portion of the casting is able to be made a desired value, so the productivity of a casting having a round-cornered portion in the sectional shape determined by the shape determining member improves.

When determining the value of the curvature radius of the round-cornered portion that is determined by the shape determining member, a casting simulation may be executed by a computer at a casting speed at which the curvature radius of the round-cornered portion of the casting becomes larger than the curvature radius of the round-cornered portion that is determined by the shape determining member, and the value of the curvature radius of the round-cornered portion that is determined by the shape determining member may be determined based on a curvature radius of a round-cornered portion of the casting obtained by the casting simulation. Also, the curvature radius of the round-cornered portion that is determined by the shape determining member may be changed and the casting simulation at the casting speed may be repeatedly executed such that the curvature radius of the round-cornered portion of the casting obtained by the casting simulation gets closer to the design value. According to this kind of structure, the curvature radius of the round-cornered portion of the shape determining member is able to be suitable for casting at higher speeds.

A preliminary casting simulation for determining the casting speed may be executed before determining the value of the curvature radius of the round-cornered portion that is determined by the shape determining member, and the casting speed may be determined based on a position of a solidification interface obtained by the preliminary casting simulation. Furthermore, the casting speed may be changed and the preliminary casting simulation may be repeatedly executed such that the position of the solidification interface obtained by the preliminary casting simulation falls within a reference range. According to this kind of structure, the curvature radius of the round-cornered portion of the shape determining member is able to be suitable for casting at even higher speeds.

In the up-drawing continuous casting method described above, casting may be performed by actual equipment using a casting condition of the casting simulation, it may be determined whether a curvature radius of a round-cornered portion of a casting cast by the actual equipment is within a reference range, and the casting condition may be changed when the curvature radius of the round-cornered portion of the casting is not within the reference range.

A second aspect of the invention relates to an up-drawing continuous casting apparatus that includes a holding furnace that holds molten metal, and a shape determining member that is arranged above a molten metal surface of the molten metal held in the holding furnace, and determines a sectional shape of a cast casting by the molten metal passing through the shape determining member. The sectional shape determined by the shape determining member includes a round-cornered portion, and a value of a curvature radius of the round-cornered portion that is determined by the shape determining member is smaller than a design value of a curvature radius of a round-cornered portion of the casting. According to this kind of structure, the curvature radius of the round-cornered portion of the casting is able to be made a desired value, so the productivity of a casting having a round-cornered portion in the sectional shape determined by the shape determining member improves.

According to the invention, an up-drawing continuous casting method and an up-drawing continuous casting apparatus that offer excellent productivity of a casting having a round-cornered portion in a sectional shape that is determined by a shape determining member, are able to be provided.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, specific example embodiments to which the invention has been applied will be described in detail with reference to the accompanying drawings. However, the invention is not limited to these example embodiments. Also, the description and the drawings are simplified as appropriate for clarity.

First Example Embodiment

Figure 1:
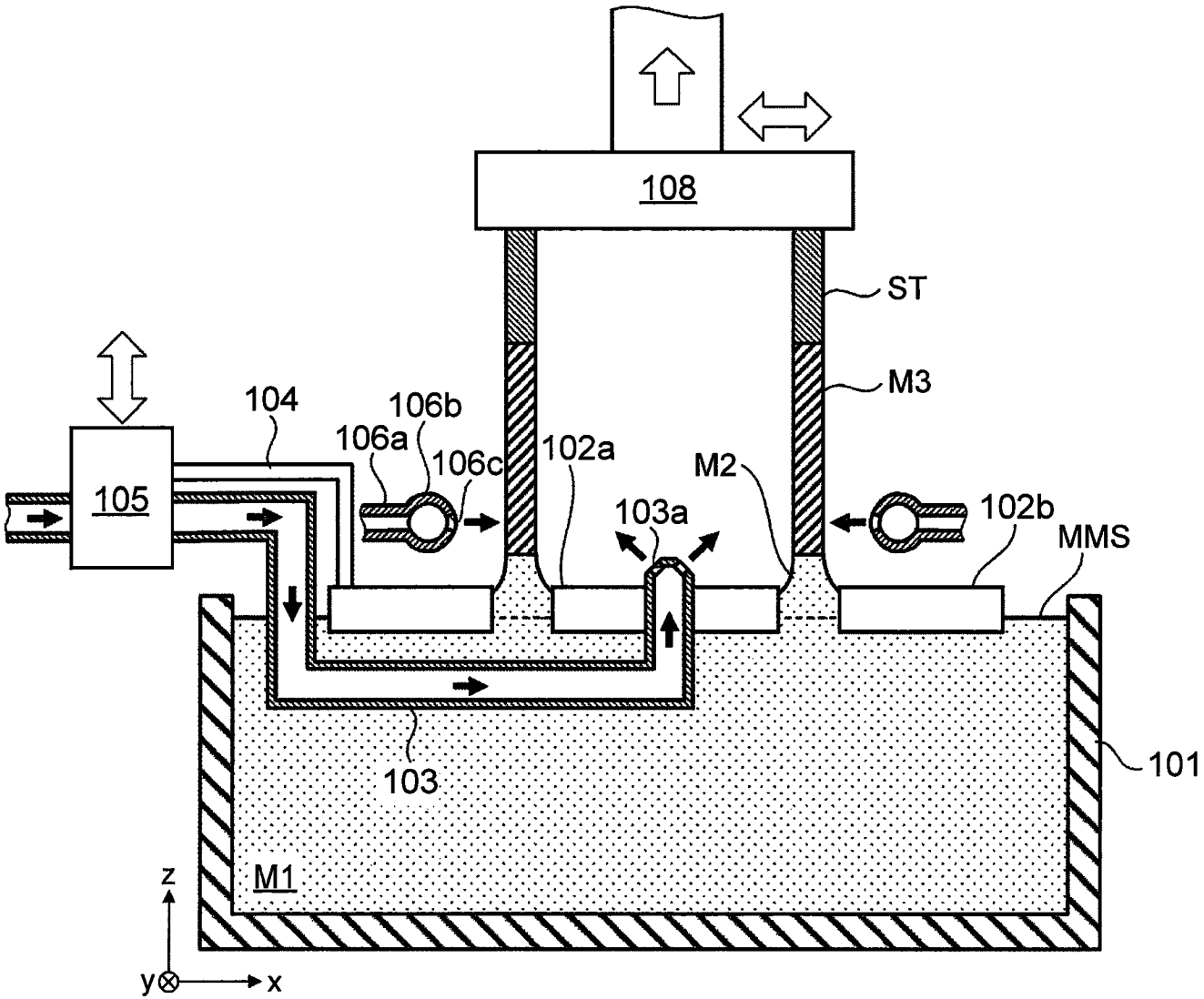
FIG. 1 is a sectional view showing a frame format of a free casting method according to a first example embodiment of the invention.

First, a free casting apparatus (up-drawing continuous casting apparatus) according to a first example embodiment of the invention will be described with reference to FIG. 1. FIG. 1 is a sectional view showing a frame format of the free casting apparatus according to the first example embodiment. As shown in FIG. 1, the free casting apparatus according to the first example embodiment includes a molten metal holding furnace 101, a shape determining member 102 (an internal shape determining member 102*a* and an external shape determining member 102*b*), an internal cooling gas nozzle 103, a support rod 104, an actuator 105, an external cooling gas nozzle 106, and an up-drawing machine 108.

Naturally, a right-handed xyz coordinate system shown in FIG. 1 is for descriptive purposes in order to illustrate the positional relationship of the constituent elements. The x-y plane in FIG. 1 forms a horizontal plane, and the z-axis direction is the vertical direction. More specifically, the plus direction of the z-axis is vertically upward. The right-handed xyz coordinate systems shown in the other drawings are the same.

The molten metal holding furnace 101 holds molten metal M1 such as aluminum or an aluminum alloy, for example, and keeps it at a predetermined temperature at which the molten metal M1 has fluidity. In the example in FIG. 1, molten metal is not replenished into the molten metal holding furnace 101 during casting, so the surface of the molten metal M1 (i.e., a molten metal surface MMS level) drops as casting proceeds. However, molten metal may also be replenished into the molten metal holding furnace 101 when necessary during casting so that the molten metal surface MMS level is kept constant. Here, the position of a solidification interface SIF can be raised by increasing a set temperature of the molten metal holding furnace 101, and lowered by reducing the set temperature of the molten metal holding furnace 101. Naturally, the molten metal M1 may be another metal or alloy other than aluminum.

Figure 2:
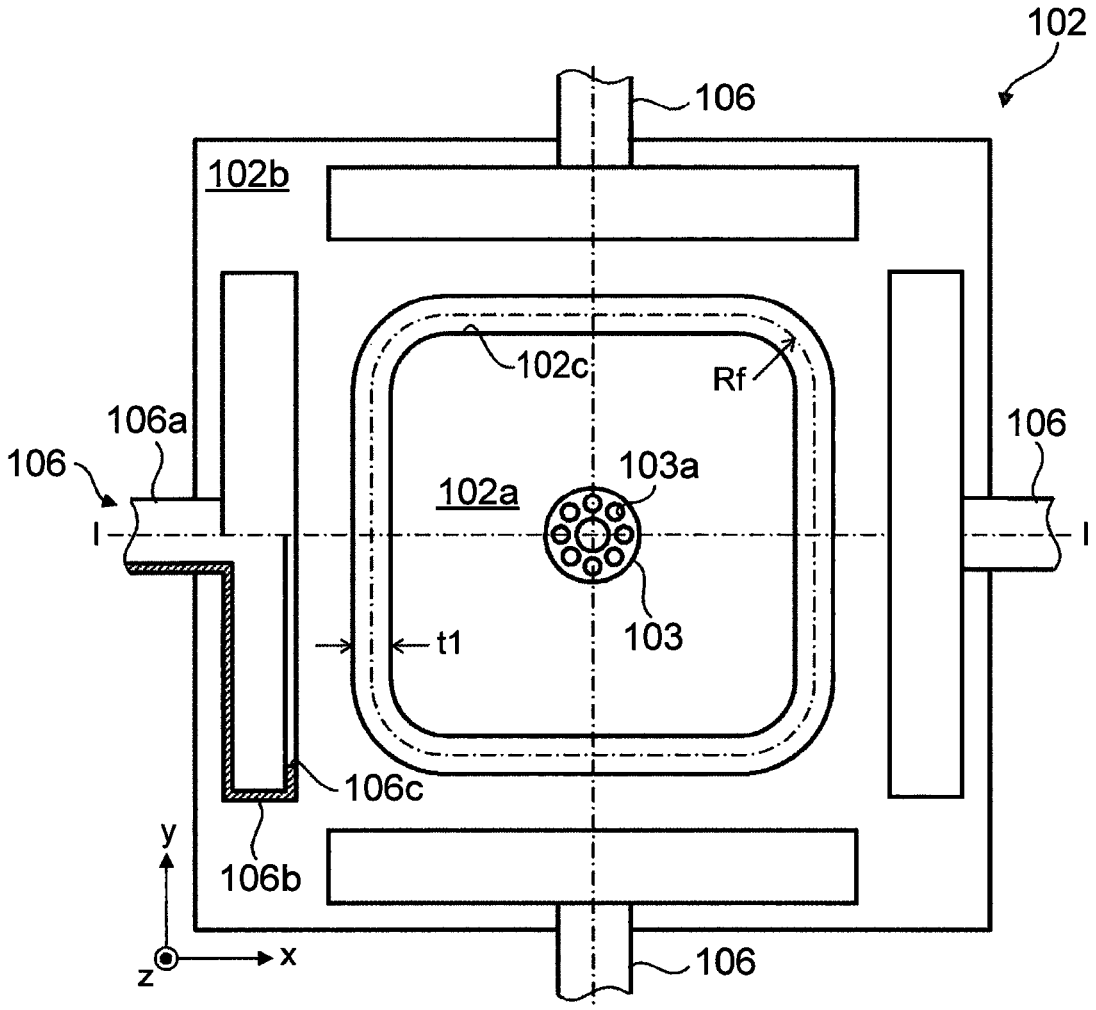
FIG. 2 is a plan view of a shape determining member according to the first example embodiment.

The shape determining member 102 is formed by the internal shape determining member 102*a* and the external shape determining member 102*b*. FIG. 2 is a plan view of the shape determining member 102. Here, the sectional view of the internal shape determining member 102*a* and the external shape determining member 102*b* in FIG. 1 corresponds to the sectional view taken along line I-I in FIG. 2. The shape determining member 102 is made of ceramic or stainless steel, for example, and is arranged above the molten metal surface MMS. The shape determining member 102 determines the sectional shape of a cast casting M3. The internal shape determining member 102*a* determines the internal shape of the pipe-like casting, and the external shape determining member 102*b* determines the external shape of the casting M3.

In the example in FIG. 1, a main surface (a lower surface) on a lower side of the shape determining member 102 (i.e., the internal shape determining member 102*a* and the external shape determining member 102*b*) is arranged contacting the molten metal surface MMS. Therefore, an oxide film that forms on the molten metal surface MMS and foreign matter floating on the molten metal surface MMS are able to be prevented from getting mixed into the casting M3. However, the lower surface of the shape determining member 102 may also be arranged a predetermined distance (e.g., approximately 0.5 mm) away from the molten metal surface MMS. When the shape determining member 102 is arranged away from the molten metal surface MMS, heat deformation and erosion of the shape determining member 102 are inhibited, so the durability of the shape determining member 102 improves.

As shown in FIG. 2, the shape determining member 102 has a rectangular planar shape, for example, and has a rectangular open portion with four round-cornered portions, in the center. The internal shape determining member 102*a* has a rectangular planar shape, for example, and is arranged in the center of the open portion of the external shape determining member 102*b*. The distance between the internal shape determining member 102*a* and the external shape determining member 102*b* forms a molten metal passage portion 102*c* through which molten metal passes. Therefore, the casting M3 shown in FIG. 1 is a hollow casting having a rectangular sectional shape in the horizontal plane and four round-cornered portions (i.e., is a square pipe). The molten metal passage portion 102*c* is formed in an annular shape with a width t1. The internal cooling gas nozzle 103 is arranged in the center of the internal shape determining member 102*a*.

As shown in FIG. 1, the molten metal M1 is drawn up following the casting M3 by the surface tension and the surface film of the molten metal M1, and passes through the molten metal passage portion 102*c* of the shape determining member 102. That is, by passing the molten metal M1 through the molten metal passage portion 102*c* of the shape determining member 102, external force is applied to the molten metal M1 from the shape determining member 102, such that the sectional shape of the casting M3 is determined. Here, the molten metal that is drawn up from the molten metal surface MMS following the casting M3 by the surface tension and surface film of the molten metal will be referred to as "retained molten metal M2". Also, the boundary between the casting M3 and the retained molten metal M2 is a solidification interface SIF.

FIG. 2 also shows four external cooling gas nozzles 106 that are arranged higher (farther toward the z-axis direction plus side) than the shape determining member 102. The details of these external cooling gas nozzles 106 will be described later. Also, the sectional shape of the casting M3 (i.e., the planar shape of the molten metal passage portion 102*c*) is not specifically limited as long as it has round-cornered portions. The casting M3 may be a solid casting such as a polygonal column having round-cornered portions.

The internal cooling gas nozzle 103 is cooling means for cooling the retained molten metal M2. As shown by the black arrows in FIG. 1, the retained molten metal M2 is indirectly cooled by the internal cooling gas nozzle 103 spraying cooling gas (e.g., air, nitrogen, argon, or the like) at the casting M3. Also, the internal cooling gas nozzle 103 is connected to a center portion of the internal shape determining member 102*a*, and supports the internal shape determining member 102*a*. As shown in FIGS. 1 and 2, the internal cooling gas nozzle 103 has a plurality of spray holes 103*a* in an end portion that protrudes from the internal shape determining member 102*a*. The casting M3 is cooled from the inside by the spray holes 103*a* spraying cooling gas (such as air, nitrogen, argon, or the like) toward the inner peripheral surface of the casting M3. In the example in FIG. 2, eight spray holes 103*a* are provided, but the number of the spray holes 103*a* is not particularly limited and may be set as appropriate.

The support rod 104 supports the external shape determining member 102*b*. The internal cooling gas nozzle 103 and the support rod 104 enable the positional relationship between the internal shape determining member 102*a* and the external shape determining member 102*b* to be maintained. The internal cooling gas nozzle 103 and the support rod 104 are connected to the actuator 105. Therefore, the internal shape determining member 102*a* and the external shape determining member 102*b* are able to be moved up and down (i.e., in the vertical direction, i.e., the z-axis direction) while maintaining this positional relationship, by the actuator 105. According to this kind of structure, the shape determining member 102 is able to be moved downward as the molten metal surface MMS level drops as casting proceeds.

The external cooling gas nozzle 106 is also cooling means for cooling the retained molten metal M2. As shown by the black arrows in FIG. 1, the retained molten metal M2 is indirectly cooled by the external cooling gas nozzle 106 spraying cooling gas (e.g., air, nitrogen, argon, or the like) at the casting M3. The position of the solidification interface SIF is able to be lowered by increasing the flow rate of the cooling gas, and raised by reducing the flow rate of the cooling gas. The external cooling gas nozzle 106 is also able to be moved up and down (i.e., in the vertical direction, i.e., in the z-axis direction) in concert with the movement of the shape determining member 102.

As shown in FIG. 2, four external cooling gas nozzles 106 extend one along each side of the molten metal passage portion 102*c* that has a rectangular shape when viewed from above. The lower half (on the minus side in the y-axis direction) of the external cooling gas nozzle 106 positioned on the left side in FIG. 2 is shown in a sectional view. As shown in FIGS. 1 and 2, the external cooling gas nozzles 106 each include an inlet pipe 106*a*, a main body portion 106*b*, and a slit 106*c*. Each main body portion 106*b* is a pipe-like member, both ends of which are closed. These main body portions 106*b* extend one along each side of the molten metal passage portion 102*c*. The slit 106*c* that extends in the length direction of the main body portion 106*b* is provided on the side of the main body portion 106*b* that faces the casting M3. Cooling gas introduced through the inlet pipe 106*a* is sprayed at the outer peripheral surface of the casting M3 from the slit 106*c* provided in the main body portion 106*b*.

The starter ST is fixed to the up-drawing machine 108. The casting M3 is cooled by the cooling gas while being drawn up by the up-drawing machine 108 via the starter ST. Therefore, the casting M3 is formed by the retained molten metal M2 near the solidification interface SIF progressively solidifying from the upper side (i.e., a plus side in the z-axis direction) toward lower side (i.e., a minus side in the z-axis direction). The position of the solidification interface SIF is able to be raised by increasing the up-drawing speed with the up-drawing machine 108, and lowered by reducing the up-drawing speed.

Also, the retained molten metal M2 is able to be drawn up diagonally by drawing the retained molten metal M2 up while moving the up-drawing machine 108 horizontally (in the x-axis direction and the y-axis direction). Therefore, the longitudinal shape of the casting M3 is able to be freely changed. The longitudinal shape of the casting M3 may also be freely changed by moving the shape determining member 102 horizontally, instead of by moving the up-drawing machine 108 horizontally.

Figure 3:
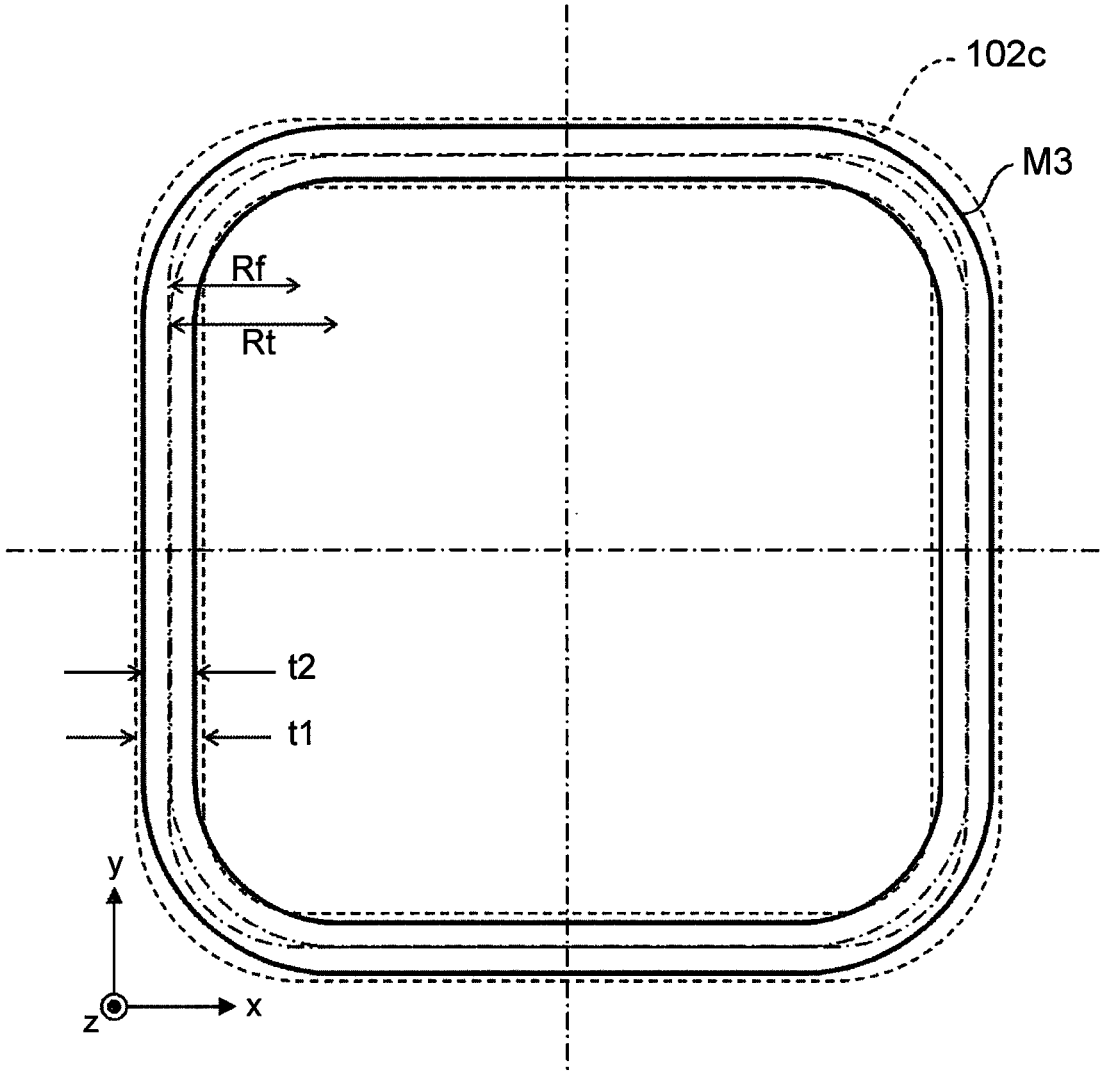
FIG. 3 is a plan view of a casting and a molten metal passage portion of the shape determining member.

Next, the shape determining member 102 according to this example embodiment will be further described with reference to FIG. 3. FIG. 3 is a plan view of the molten metal passage portion 102*c* of the shape determining member 102, and the casting M3. The casting M3 is denoted by the solid line and the molten metal passage portion 102*c* is denoted by the broken line. As shown in FIG. 3, with the shape determining member 102 according to this example embodiment, a curvature radius Rf of a center line of the round-cornered portion of the molten metal passage portion 102*c* is smaller than a target curvature radius (a design value of a curvature radius of a round-cornered portion of the casting M3) Rt of a center line of the round-cornered portion of the casting M3. Therefore, if the casting speed is increased and the solidification interface SIF rises, a casting M3 having the target curvature radius Rt is able to be obtained. Therefore, by using the shape determining member 102 according to this example embodiment, the casting speed can be faster than it is with the related art, thereby enabling productivity to be improved. As shown in FIG. 3, the thickness t2 of the casting M3 is less than the width t1 of the molten metal passage portion 102*c*.

On the other hand, with the shape determining member 102 according to the related art, the curvature radius Rf of the center line of the round-cornered portion of the molten metal passage portion 102*c* matches the target curvature radius Rt of the center line of the round-cornered portion of the casting M3. Therefore, if the casting speed is increased and the solidification interface SIF rises, the curvature radius Rc of the round-cornered portion of the casting M3 will end up being larger than the target curvature radius Rt. Therefore, when the shape determining member 102 of the related art is used, the casting speed is unable to be increased. The difference between the curvature radius Rc of the round-cornered portion of the cast casting M3 and the target curvature radius Rt increases as the solidification interface SIF becomes higher (i.e., as the casting speed increases).

Figure 4:
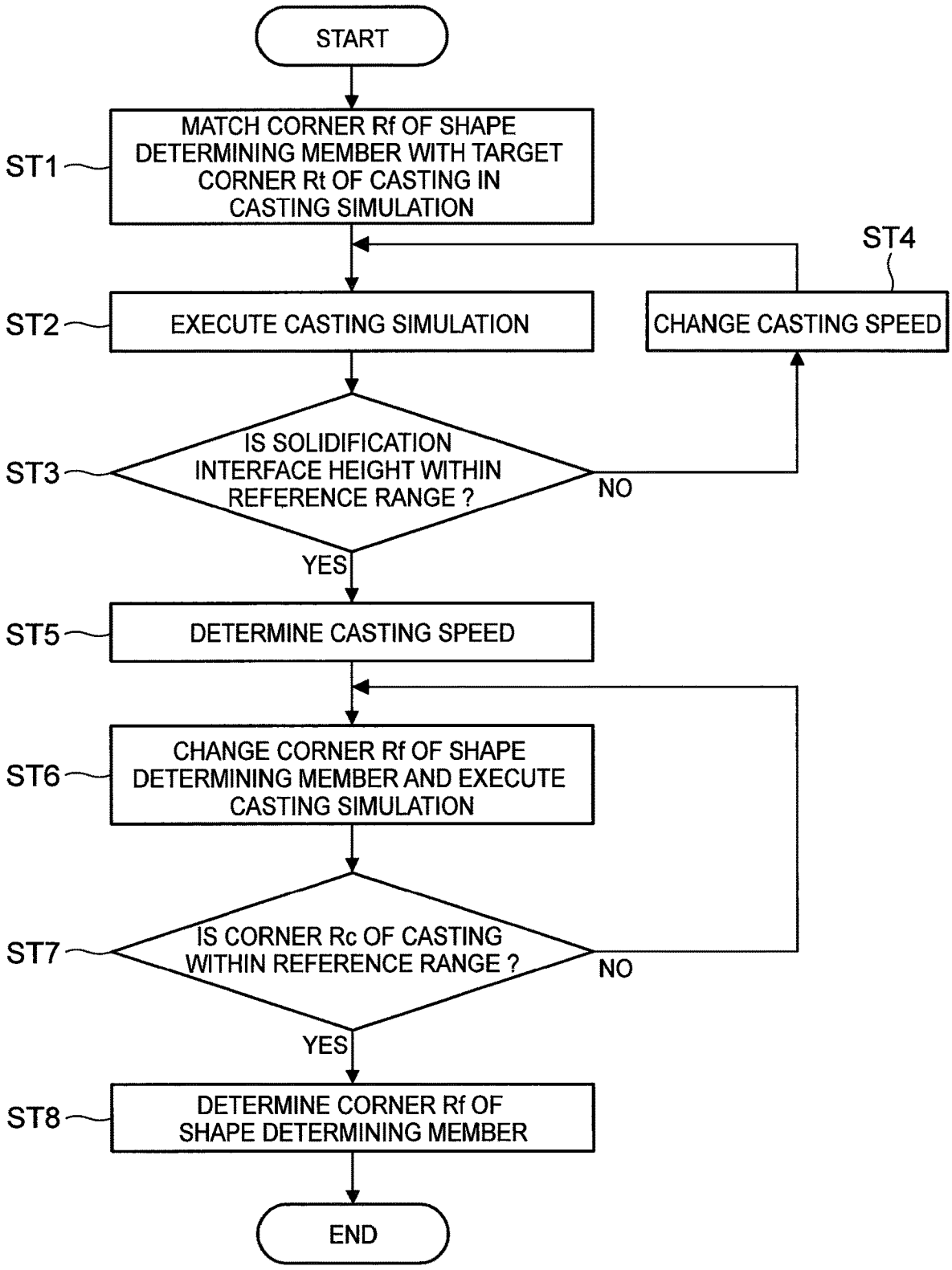
FIG. 4 is a flowchart illustrating a method for determining a curvature radius of a round-cornered portion that is determined by the shape determining member.

Next, a method for determining the curvature radius Rf of the round-cornered portion that is determined by the shape determining member 102, in the free casting method (i.e., the up-drawing continuous casting method) according to the first example embodiment will be described with reference to FIG. 4. FIG. 4 is a flowchart illustrating the method for determining the curvature radius Rf of the round-cornered portion that is determined by the shape determining member 102. As shown in FIG. 4, casting simulation by computer may be used when determining the curvature radius Rf of the round-cornered portion that is determined by the shape determining member 102. This enables the curvature radius Rf of the round-cornered portion that is determined by the shape determining member 102 to be suitable for higher speed casting.

First, in the casting simulation, the curvature radius Rf of the round-cornered portion that is determined by the shape determining member 102 is made to match the target curvature radius Rt of the round-cornered portion of the casting M3 (step ST1). In FIG. 4, the curvature radius Rf of the round-cornered portion that is determined by the shape determining member 102 is simply denoted as the "corner Rf of the shape determining member 102" or the like.

Next, the molten metal temperature, the cooling condition, and the casting speed are set appropriately, and the casting simulation is executed (step ST2). The casting simulation in step ST2 is a preliminary simulation for determining the casting speed. Here, for example, the molten metal temperature may be set to approximately the same as the molten metal temperature of the actual casting apparatus (i.e., the actual equipment). Also, the cooling condition (i.e., the cooling gas flow rate) may be set to a relatively large value at which casting is possible in the actual equipment, for example, because it is desirable to increase the casting speed.

Next, it is determined whether the position of the solidification interface SIF (i.e., the solidification interface height) obtained by the casting simulation is within a reference range (step ST3). Here, as the casting speed increases and the curvature radius Rc of the round-cornered portion of the casting M3 becomes larger than the curvature radius Rf of the round-cornered portion that is determined by the shape determining member 102, the solidification interface SIF of the round-cornered portion becomes higher than the solidification interface SIF of the straight portion. Therefore, the position of the solidification interface SIF is preferably determined by the straight portion of the casting M3.

The casting speed is also faster the higher the position of the solidification interface SIF is, so high position of the solidification interface SIF is preferable from the viewpoint of productivity. However, if the position of the solidification interface SIF becomes too high, the retained molten metal M2 will end up tearing, and thus will no longer be able to be cast. From this viewpoint, the reference range of the position of the solidification interface SIF may be determined. Tearing of the retained molten metal M2 can also be simulated by the casting simulation.

If the position of the solidification interface SIF is not within the reference range (i.e., NO in step ST3), the casting speed is changed (step ST4). More specifically, if the position (height) of the solidification interface SIF exceeds the reference range, the casting speed is reduced. On the other hand, if the position (height) of the solidification interface SIF is lower than the reference range, the casting speed is increased. Then, the process returns to step ST2, and the casting simulation is executed again.

If the position of the solidification interface SIF is within the reference range (i.e., YES in step ST3), that value is selected as the casting speed (step ST5). Naturally, at this selected casting speed, the curvature radius Rc of the round-cornered portion of the casting M3 obtained by the casting simulation will become larger than the curvature radius Rf of the round-cornered portion that is determined by the shape determining member 102 (i.e., the target curvature radius Rt of the round-cornered portion of the casting M3).

Next, the curvature radius Rf of the round-cornered portion that is determined by the shape determining member 102 is changed and the casting simulation is executed (step ST6). First, the curvature radius Rf of the round-cornered portion that is determined by the shape determining member 102 is made smaller than the target curvature radius Rt of the round-cornered portion of the casting M3. Next, it is determined whether the curvature radius Rc of the round-cornered portion of the casting M3 obtained by the casting simulation is within the reference range (step ST7). Here, the reference range of the curvature radius of the round-cornered portion of the casting M3 may be appropriately set from the target curvature radius Rt of the round-cornered portion of the casting M3.

If the curvature radius Rc of the round-cornered portion of the casting M3 is not within the reference range (i.e., NO in step ST7), the process returns to step ST6, and the curvature radius Rf of the round-cornered portion that is determined by the shape determining member 102 is changed, and the casting simulation is executed again. More specifically, if the curvature radius Rc of the round-cornered portion of the casting M3 exceeds the reference range, the curvature radius Rf of the round-cornered portion that is determined by the shape determining member 102 is reduced even more. On the other hand, if the curvature radius Rc of the round-cornered portion of the casting M3 is below the reference range, the curvature radius Rf of the round-cornered portion that is determined by the shape determining member 102 is increased. If the curvature radius Rc of the round-cornered portion of the casting M3 is within the reference range (i.e., YES in step ST7), that value is selected as the curvature radius Rf of the round-cornered portion that is determined by the shape determining member 102 (step ST8). The curvature radius Rf of the round-cornered portion that is determined by the shape determining member 102 is able to be determined according to these steps.

Figure 5:
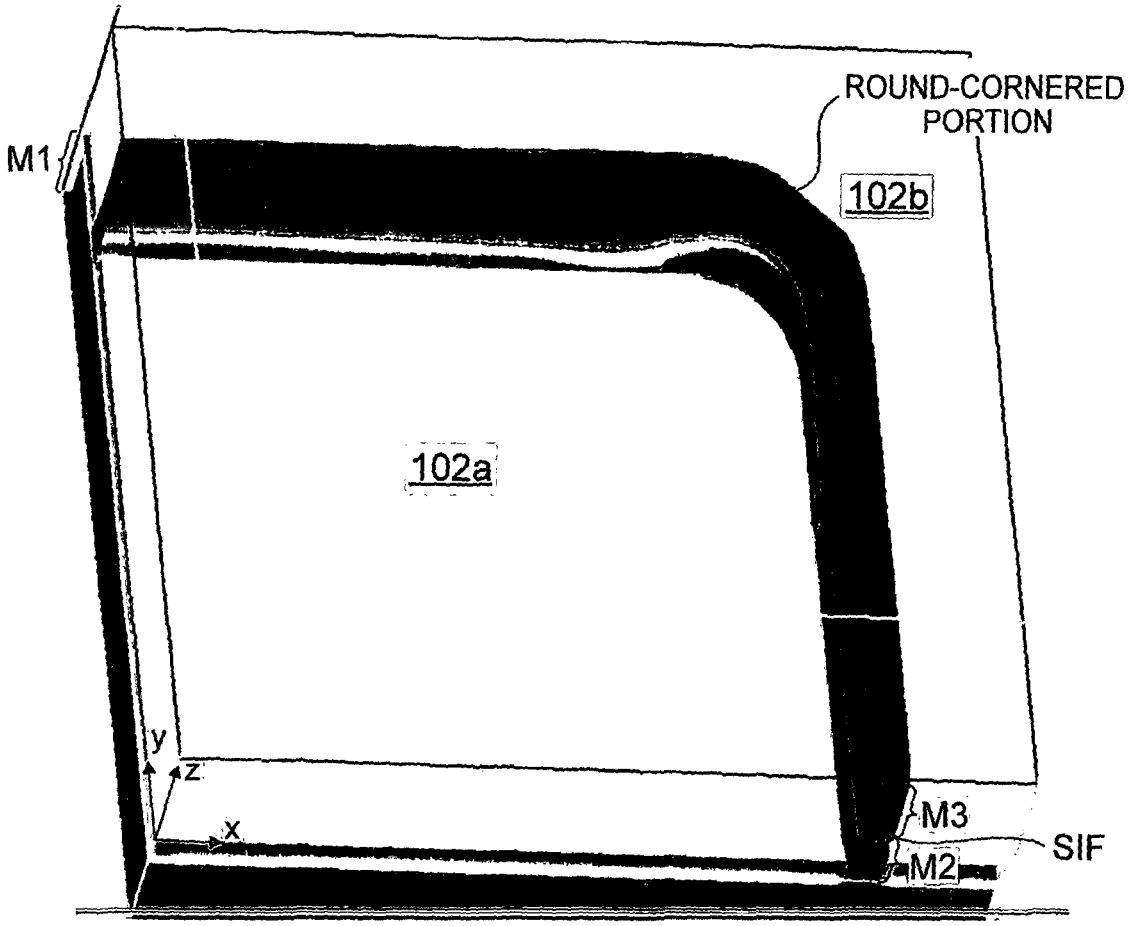
FIG. 5 is a perspective view of one example of a casting simulation result.

FIG. 5 is a perspective view of one example of a casting simulation result. The casting simulation is performed on only the upper right ¼ in FIG. 3, taking symmetry into account. As shown in FIG. 5, the curvature radius Rc of the round-cornered portion of the casting M3, and the position of the solidification interface SIF are able to be known from the casting simulation.

Figure 6:
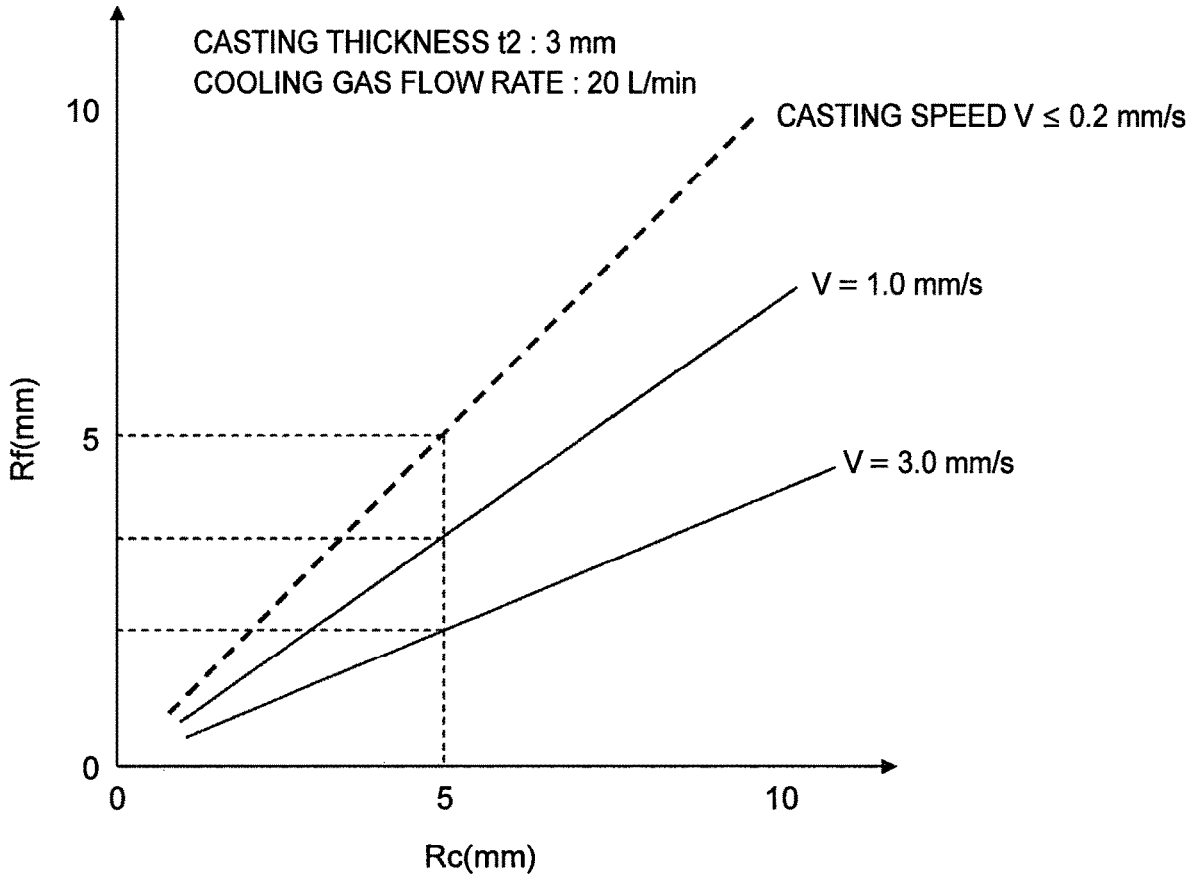
FIG. 6 is a graph showing the relationship between a curvature radius (horizontal axis) of the round-cornered portion, and a curvature radius (vertical axis) of the round-cornered portion that is determined by the shape determining member, of the casting obtained by the casting simulation.

FIG. 6 is a graph showing the relationship between the curvature radius Rc (horizontal axis) of the round-cornered portion of the casting M3 obtained by the casting simulation, and the curvature radius Rf (vertical axis) of the round-cornered portion that is determined by the shape determining member 102. The result is for a case in which the thickness of the casting M3 such as that shown in FIG. 3 is 3 mm and the cooling gas flow rate is 20 L/min. In the example shown in FIG. 6, when the casting speed V≤0.2 mm/s, the curvature radius Rf of the round-cornered portion that is determined by the shape determining member 102 matches the curvature radius Rc of the round-cornered portion of the casting M3. On the other hand, when the casting speed V exceeds 0.2 mm/s, the curvature radius Re of the round-cornered portion of the casting M3 becomes larger than the curvature radius Rf of the round-cornered portion that is determined by the shape determining member 102. That is, when the casting speed V exceeds 0.2 mm/s, the curvature radius Rf of the round-cornered portion that is determined by the shape determining member 102 needs to be made smaller than the target curvature radius Rt of the round-cornered portion of the casting M3. Also, the difference between the curvature radius Rf of the round-cornered portion that is determined by the shape determining member 102 and the target curvature radius Rt of the round-cornered portion of the casting M3 needs to be increased as the casting speed increases.

Figure 7:
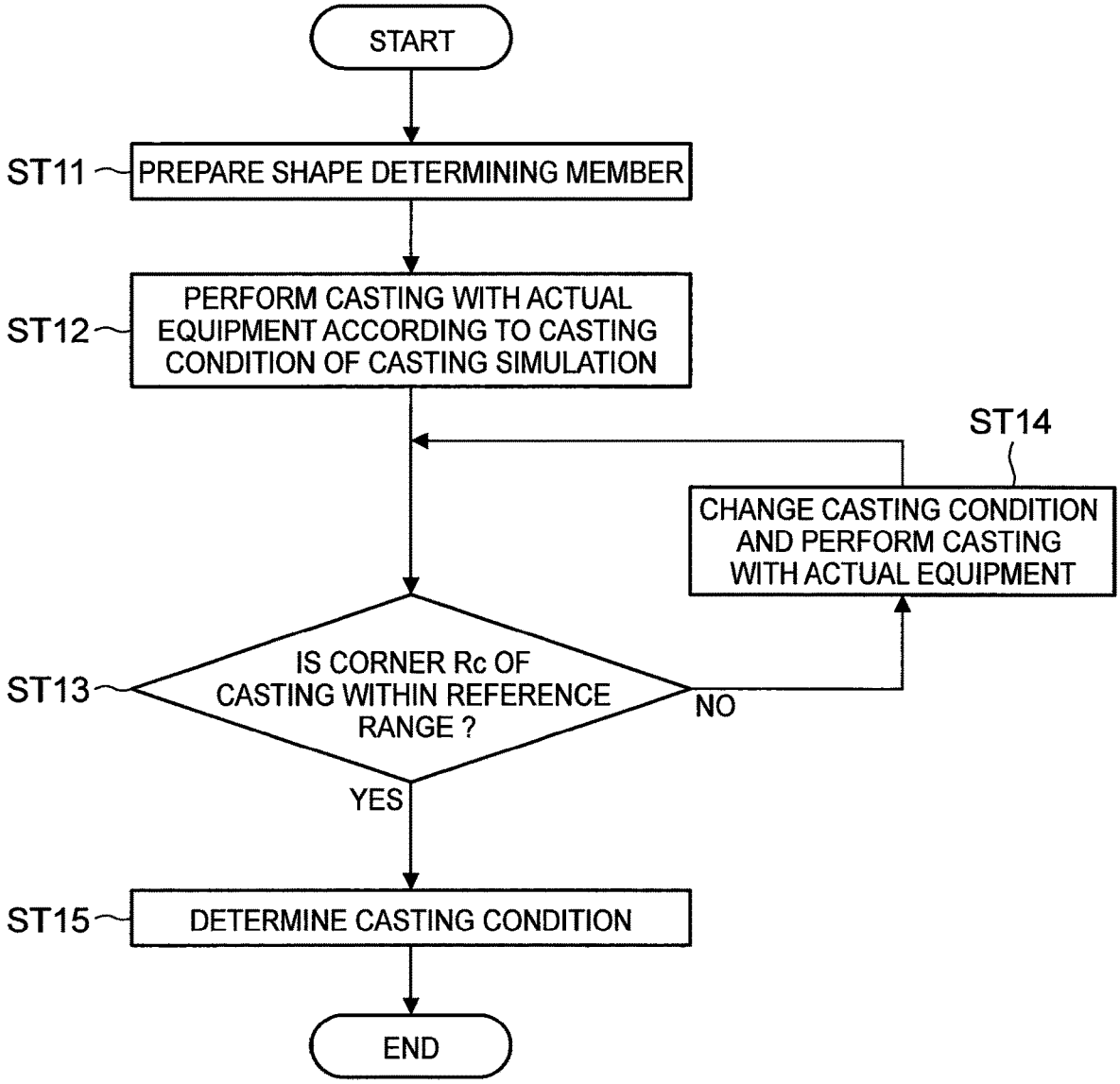
FIG. 7 is a flowchart illustrating a method for determining the casting conditions in the actual equipment.

Next, the method for determining the casting condition of the actual equipment will be described with reference to FIG. 7. FIG. 7 is a flowchart illustrating the method for determining the casting condition of the actual equipment. This flowchart of the method for determining the casting condition of the actual equipment follows the flowchart of the method for determining the curvature radius Rf of the round-cornered portion that is determined by the shape determining member 102 shown in FIG. 4. First, the shape determining member 102 having the curvature radius Rf of the round-cornered portion that is determined by the method shown in FIG. 4 is prepared (step ST11). Next, casting is performed by the actual equipment, using the casting condition of the casting simulation shown in FIG. 4 (step ST12). Then, it is determined whether the curvature radius Rc of the round-cornered portion of the casting M3 cast by the actual equipment is within the reference range (step ST13).

If the curvature radius Rc of the round-cornered portion of the casting M3 is not within the reference range (i.e., NO in step ST13), the casting condition is changed (step ST14). More specifically, if the curvature radius Rc of the round-cornered portion of the casting M3 is exceeding the reference range, the position of the solidification interface SIF needs to be lowered. Therefore, the molten metal temperature is lowered, or the casting speed is reduced, or the cooling gas flow rate is increased. On the other hand, if the curvature radius Rc of the round-cornered portion of the casting M3 is below the reference range, the position of the solidification interface SIF needs to be raised. Therefore, the molten metal temperature is increased, or the casting speed is increased, or the cooling gas flow rate is reduced. Then, the process returns to step ST13, and casting is performed again by the actual equipment.

If the curvature radius Rc of the round-cornered portion of the casting M3 is within the reference range (i.e., YES in step ST13), that condition is selected as the casting condition (step ST15). The casting condition of the actual equipment is able to be determined by these steps. As illustrated in step S12, the casting condition used in the casting simulation is able to be used as the starting point, so the number of castings performed by the actual equipment in order to determine the casting condition is able to be reduced.

The invention is not limited to the example embodiments described above, and may be modified as appropriate without departing from the spirit of the invention.

The invention claimed is:

1. An up-drawing continuous casting method comprising: drawing up molten metal held in a holding furnace, through a shape determining member that determines a sectional shape of a cast casting, wherein the sectional shape determined by the shape determining member includes a round-cornered portion; and a value of a curvature radius of the round-cornered portion that is determined by the shape determining member is smaller than a design value of a curvature radius of a round-cornered portion of the casting; wherein:

when determining the value of the curvature radius of the round-cornered portion that is determined by the shape determining member, a casting simulation is executed by a computer at a casting speed at which the curvature radius of the round-cornered portion of the casting becomes larger than the curvature radius of the round-cornered portion that is determined by the shape determining member; and the value of the curvature radius of the round-cornered portion that is determined by the shape determining member is determined based on a curvature radius of a round-cornered portion of a casting obtained by the casting simulation.

2. The up-drawing continuous casting method according to claim 1, wherein the curvature radius of the round-cornered portion that is determined by the shape determining member is changed and the casting simulation at the casting speed is repeatedly executed such that the curvature radius of the round-cornered portion of the casting obtained by the casting simulation gets closer to the design value.

3. The up-drawing continuous casting method according to claim 1, wherein a preliminary casting simulation for determining the casting speed is executed before determining the value of the curvature radius of the round-cornered portion that is determined by the shape determining member; and the casting speed is determined based on a position of a solidification interface obtained by the preliminary casting simulation.

4. The up-drawing continuous casting method according to claim 3, wherein the casting speed is changed and the preliminary casting simulation is repeatedly executed such that the position of the solidification interface obtained by the preliminary casting simulation falls within a reference range.

5. The up-drawing continuous casting method according to claim 1, wherein casting is performed by actual equipment using a casting condition of the casting simulation;

it is determined whether a curvature radius of a round-cornered portion of a casting cast by the actual equipment is within a reference range; and the casting condition is changed when the curvature radius of the round-cornered portion of the casting is not within the reference range.

6. An up-drawing continuous casting apparatus comprising:

a holding furnace that holds molten metal, and a shape determining member that is arranged above a molten metal surface of the molten metal held in the holding furnace, and determines a sectional shape of a cast casting by the molten metal passing through the shape determining member, wherein the sectional shape determined by the shape determining member includes a round-cornered portion; and a computer configured to execute a casting simulation for determining a value of a curvature radius of the round-cornered portion that is determined by the shape determining member at a casting speed at which a curvature radius of a round-cornered portion of the casting becomes larger than the curvature radius of the round-cornered portion that is determined by the shape determining member, wherein:

the value of the curvature radius of the round-cornered portion that is determined by the shape determining member is determined based on a curvature radius of a round-cornered portion of a casting obtained by the casting simulation; and the value of the curvature radius of the round-cornered portion that is determined by the shape determining member is smaller than a design value of a curvature radius of a round-cornered portion of the cast casting.

* * * * *